United States Patent [19]

Leitch

[11] 4,263,863

[45] Apr. 28, 1981

[54] COVER ARRANGEMENT FOR A CONTAINER

[75] Inventor: George J. Leitch, South Gosforth, England

[73] Assignee: MacGregor International S.A., Basel, Switzerland

[21] Appl. No.: 32,930

[22] Filed: Apr. 24, 1979

[30] Foreign Application Priority Data

Apr. 24, 1978 [GB] United Kingdom ..... 16026/78

[51] Int. Cl.[3] ..... E05F 11/06

[52] U.S. Cl. ..... 114/201 R

[58] Field of Search ..... 114/201 R, 202

[56] References Cited

U.S. PATENT DOCUMENTS

| | | | |
|---|---|---|---|
| 3,077,225 | 2/1963 | Aarvold | 114/202 X |
| 3,348,516 | 10/1967 | Caillet | 114/202 |
| 3,952,790 | 4/1976 | Leitch | 114/202 X |

FOREIGN PATENT DOCUMENTS

| | | | |
|---|---|---|---|
| 191479 | 9/1964 | Sweden | 114/202 |
| 195949 | 5/1965 | Sweden | 114/202 |
| 921188 | 3/1963 | United Kingdom | 114/202 |

*Primary Examiner*—Douglas C. Butler

*Attorney, Agent, or Firm*—Spencer & Kaye

[57] ABSTRACT

A cover arrangement for a container, for example for a ship's hatchway, has a cover element which is hinged at one side. The hinging includes a lost motion connection, which allows automatic engagement and disengagement of mutually engageable member at that side for cleating. This is achieved by movement of the cover element in its closed position within the scope of the lost motion connection. The cover element may include other automatic cleating member on other sides; the cleating is preferably effected by final closing movement of the cover element under gravity.

11 Claims, 8 Drawing Figures

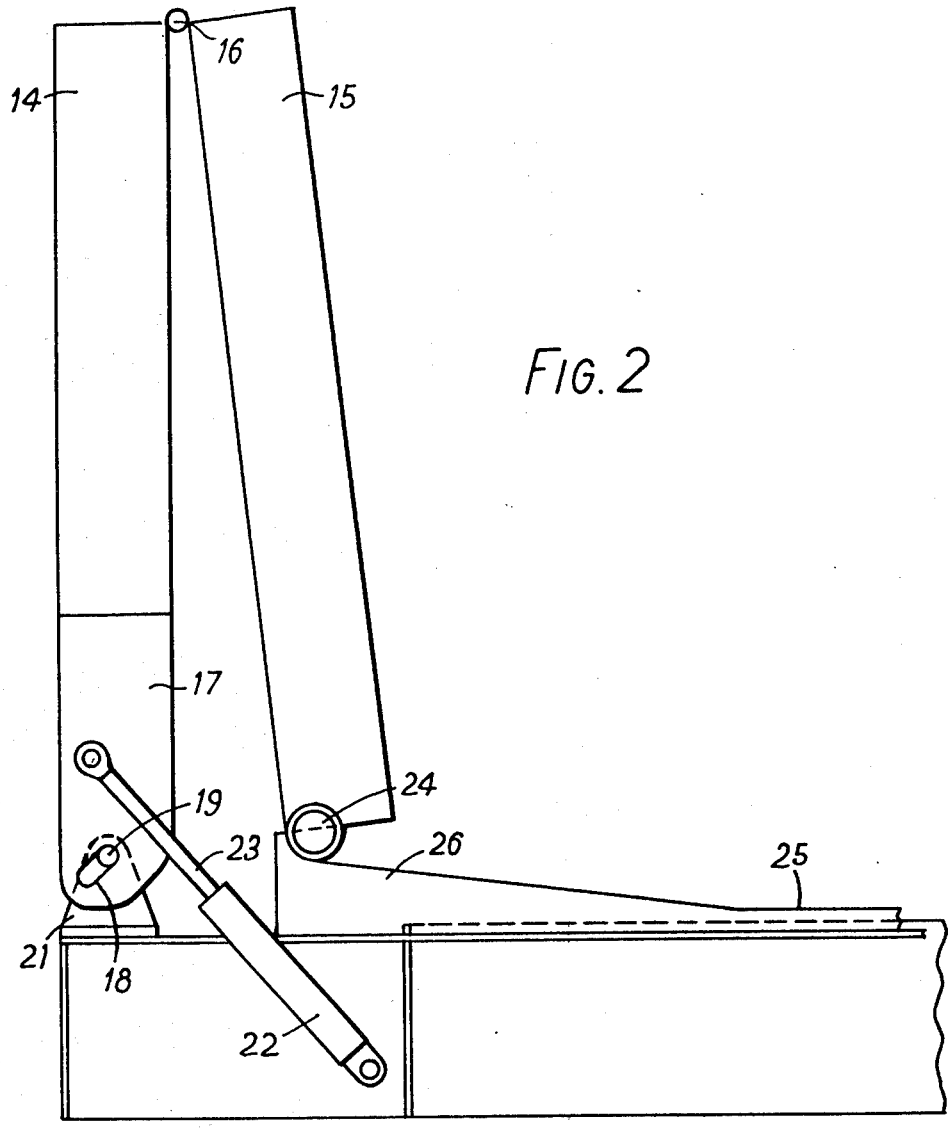
FIG. 2
FIG. 5
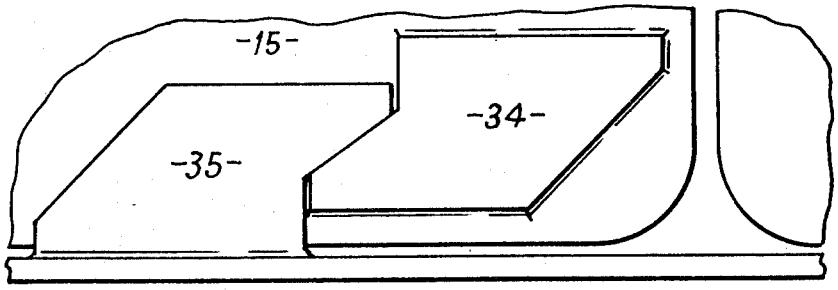

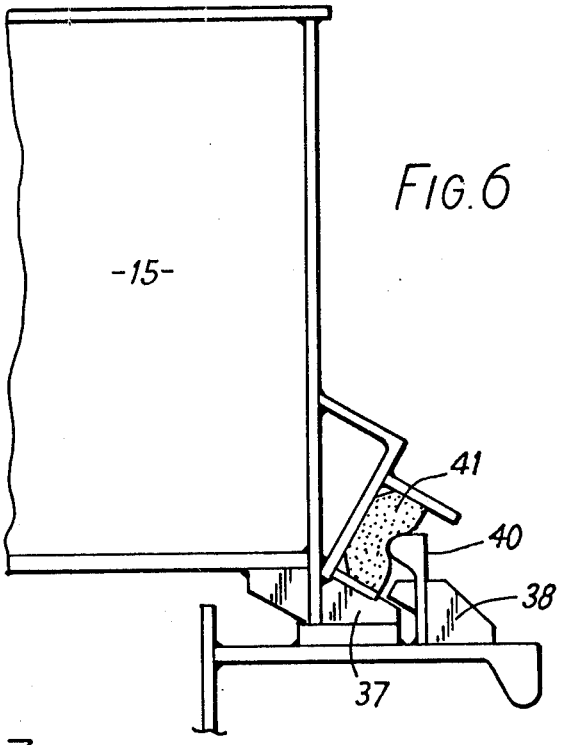
FIG. 6
FIG. 7
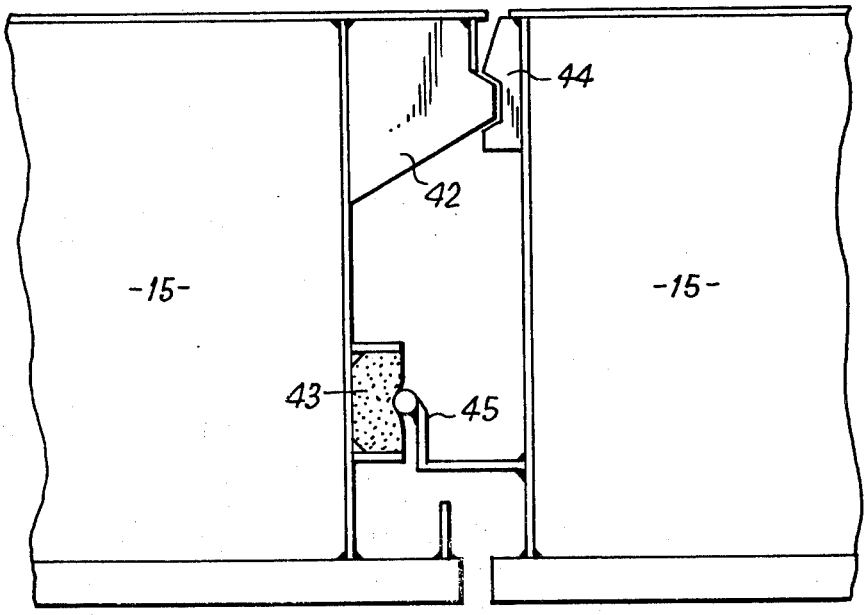

COVER ARRANGEMENT FOR A CONTAINER

The present invention relates to cover arrangements for containers. The invention is particularly applicable to hatch covers for ships, but as will be clearly understood, cover arrangements in accordance with the invention may be used in any suitable location or vehicle such as grain storage buildings or railway wagons.

Cover arrangements which employ a single cover element or a plurality of cover elements which are hinged together and movable together to open a container are known. Some such cover arrangements are provided with manual cleating which is a time consuming operation, and some are provided along the sides with cleats which operate automatically by sliding during opening and closing of the container. Where cover arrangements have their single cover element, or in the case of cover arrangements employing a plurality of cover elements their first cover element, pivotally coupled to the container it is difficult to effect an efficient automatic cleating at that pivotted side. This is because the normal pivotting movement of that side does not allow sideways movement of the cover element of effect entry and release of cleating elements.

This invention seeks to provide a cover arrangement which permits cleating at or towards the hinged end of a single cover element or a first cover element of such an arrangement.

According to one aspect of the invention there is provided a cover arrangement for a container comprising a cover element which is pivotally coupled at one side to the container via a lost motion connection, the cover and the container having mutually engageable means at said one side which effect cleating, wherein pivotal lowering of the cover element brings said means into alignment and a subsequent lateral movement of the cover in its horizontal position, within the scope of the lost-motion connection, effects engagement of said means.

The lost motion connection may be effected by means of a pin engaging a slot and this connection may serve to provide the pivotal connection.

The invention also includes a container provided with a cover arrangement as hereinbefore defined in which the container is provided with engagement means for co-operation with the cleating means.

In order that the invention and its various other preferred features may be understood more easily, an embodiment thereof will now be described, by way of example only, with reference to the drawings in which:

FIG. 2 is a schematic side view of a hatch cover arrangement constructed in accordance with the invention.

FIG. 5 is a detail view showing one suitable form of side cleating for the cover elements which is usable in the construction of FIG. 2.

FIG. 6 is a detailed cross-sectional view showing one suitable form of cleating for the opposite end of the construction of FIG. 2.

FIG. 7 is a detailed cross-sectional view showing one suitable form of cross-joint sealing of the construction shown in FIG. 1.

Figure 1:
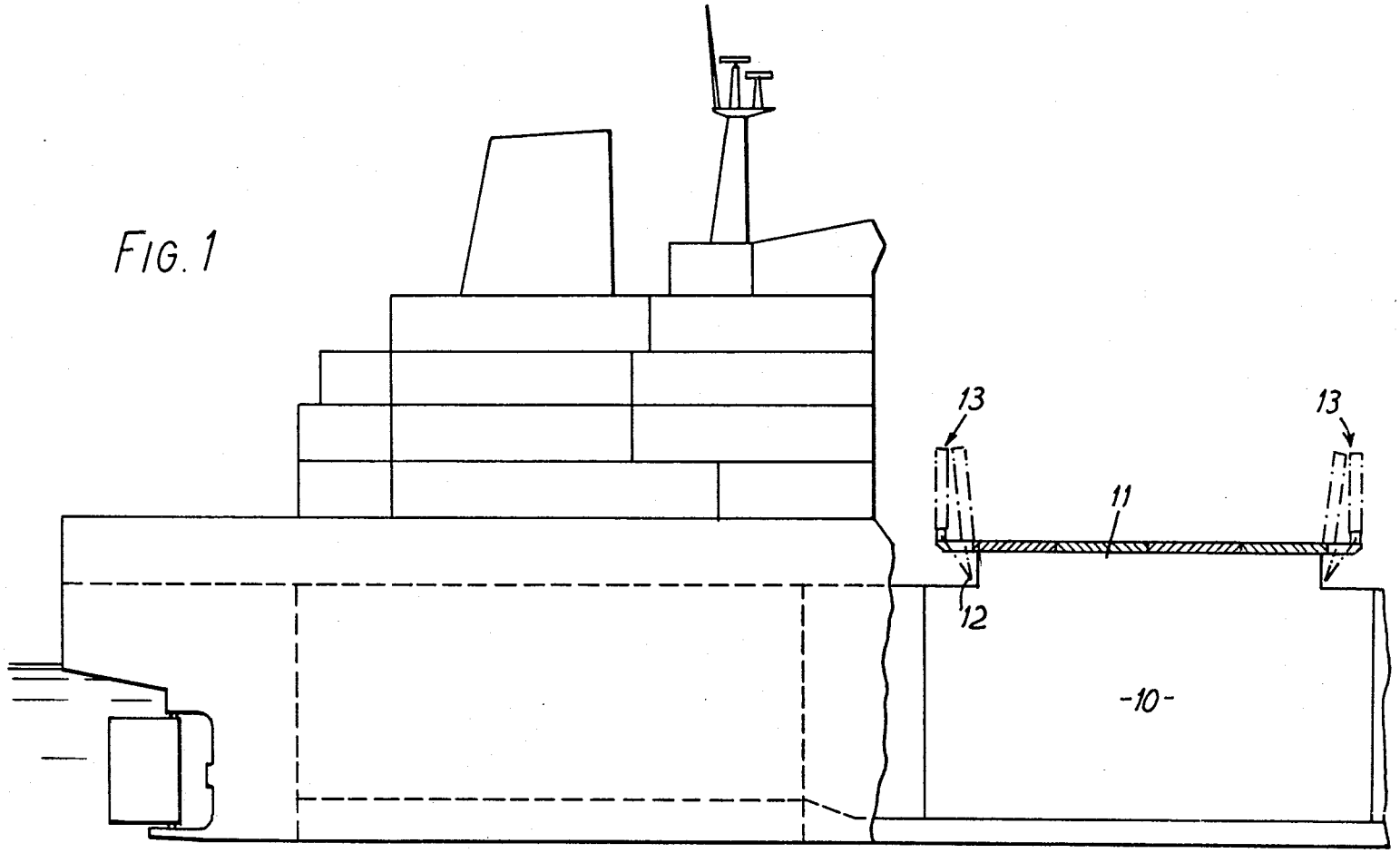
FIG. 1 shows the aft end of a ship with a hatch provided with a hatch cover arrangement constructed in accordance with the invention.

The drawing of FIG. 1 shows a ship and a container formed by a rear stowage area 10. The stowage area is provided with a hatchway 11 having a coaming 12 and which is closable by means of two cover arrangements 13 each constructed in accordance with the invention.

FIG. 2 shows in greater detail a cover arrangement 13. The cover arrangement comprises a first cover element 14 and a second cover element 15 which are connected by a hinge 16 at adjacent ends. The first cover element 14 has a pair of arms 17, one at each side, which project beyond the end of the cover element remote from the hinge. The end of each arm 17 has a slot 18 for receiving a pin 19 of a respective support in the form of a pedestal 21 mounted on the deck of a ship. The first cover element is in this way pivotally mounted on the ship.

A pair of hydraulic or pneumatic piston/cylinder assemblies 22 are coupled one to each of the cover elements and also to the ships structure and are arranged such that extension of piston arms 23 by application of hydraulic or pneumatic pressure to the cylinders causes pivoting of the cover element 14 outwardly of the hatchway from a horizontal to a vertical position to open the hatchway. It will be appreciated that due to the hinge connection between first and second cover elements the two cover elements will be raised by this action so that they move from an end-to-end in-line configuration closing the hatchway to a vertical face-to-face disposition as shown in FIG. 2. The second cover element 15 is provided at its end remote from the hinge with wheels 24 one to each side of the cover element which wheels run in guide rails 25 provided on the ship which extend one along each side of the hatchway. The rails have a ramp portion 26 up which the wheels run during opening of the cover. The ramp aids the closing action in that the cover element tends to run down the ramp when the opening pressure is released.

Figure 3:
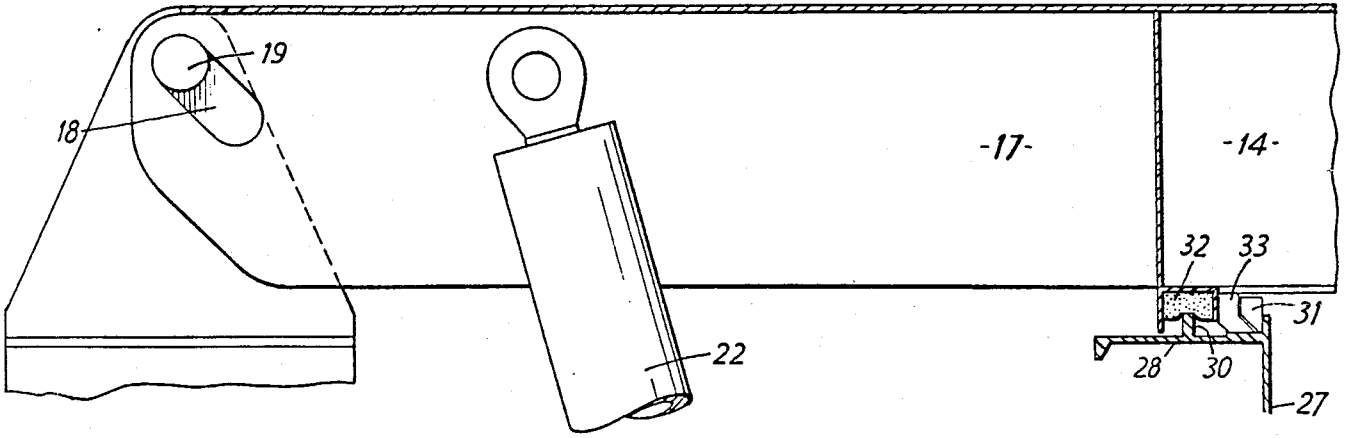
FIG. 3 is an enlarged view of one end of the first cover element of the arrangement of FIG. 2 in a closed position.

The drawing of FIG. 3 shows the hinge end of the first cover element when the cover is closed in order to show a cleating arrangement for the end of the cover element. The end 27 of the hatchway projects upwardly from the deck and has an outwardly projecting flange 28 with an upward projection 30 which extends from one side of the hatchway to the other. The outside of the end 27 is provided with a cleating member 31 spaced apart along the end of the hatch at positions chosen to align with horizontal girder supports of the cover element which defines an engagement surface which is inclined outwardly and upwardly from the flange 28 to define a wedging recess.

The end of the first cover element 14 as shown in FIG. 3 is provided with a resilient sealing buffer 32 which extends from one side of the cover element to the other, and which is positioned for sealing engagement with the projection 30. The end of the cover element is also provided with a cleating member 33 which defines an engagement surface of wedge formation for mating engagement with the wedging recess defined by the cheating member 31. It will be appreciated that co-operation between the mating surfaces of the cleating members induces compression of the sealing buffer 32.

Figure 4:
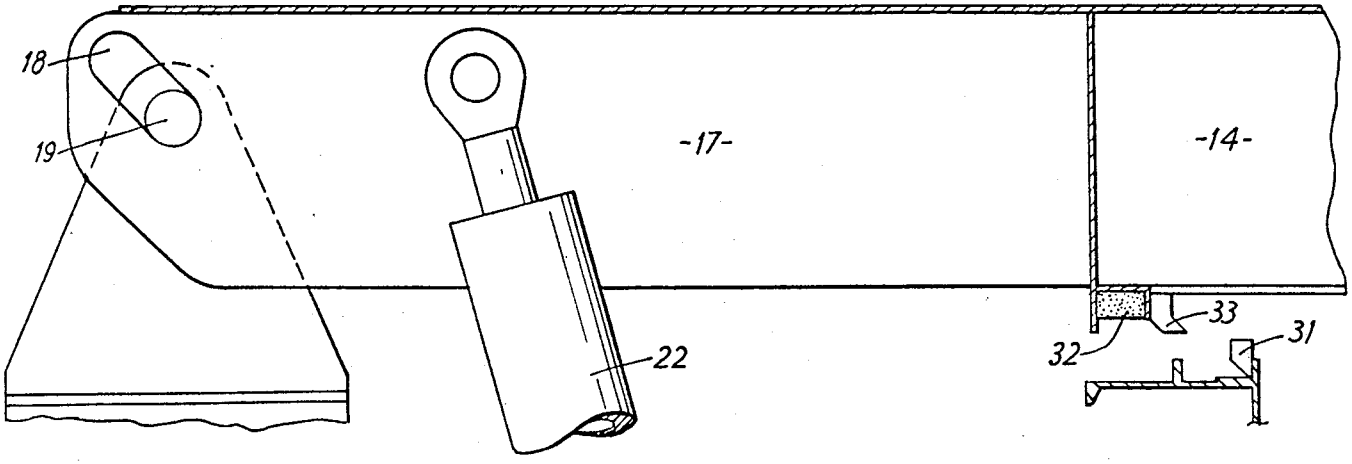
FIG. 4 is an enlarged view of one end of the first cover element of the arrangement of FIG. 2 in an intitial opening position.

As will be seen in the drawing of FIG. 3, when the cover arrangement is closed the pins 19 are situated at the top of the slots 18. In order to release the engagement between cleating members 33 and 31 the cover element 14 must be moved initially backwardly towards the pedestals 21 and this is permitted by means of the slots 18 which permit movement of the arms on the pins and backward movement of the cover element upon initial extension of the piston arms 23 prior to pivotal movement when the pins reach the other end of the slots. The effect of this initial release movement is shown in FIG. 4.

The first and second cover elements 14 and 15 are provided with side cleating, as can be seen in FIG. 5, in the form of wedges 34 which co-operate with wedging recesses formed in abutments 35 provided along the coaming to the side of the hatch opening such that automatic sliding engagement of the wedges with the recess occurs as the panels are moved into the closed position.

When a single cover arrangement is required to close a hatchway the last cover element eg. cover element 15 may be provided with end cleating as can be seen in FIG. 6 This comprises a wedge 37 which extends along the end of the panel 15 opposite to the hinge and co-operates with a wedging recess formed in an abutment 38 on the end coaming. As the panels are moved into the closed position the wedge 37 is moved into engagement with the recess in the abutment 38 to automatically cleat the end of the panel 15. The end coaming is provided with a sealing strip 40 which engages a resilient seal 41 carried by the panel 15.

FIG. 7 shows cross-joint sealing between end covers 15 of two cover arrangements as shown in FIG. 1 for closing a single hatchway. An identical cross-joint sealing is also employed between all of the other joints e.g. between cover elements 14 and 15. The end of one cover element is provided with wedge element 42 spaced apart across its width and a sealing strip 43 which extends from one side to the other of the cover element. The other panel element 15 is provided with recessed wedge receiving elements 44 shaped to receive the wedging elements in wedging engagement therewith and a projection 45 which extends from one side to the other of the cover element and is positioned for sealing engagement with the sealing strip 43 upon mutual engagement of the wedge element 42 and element 44.

Figure 8:
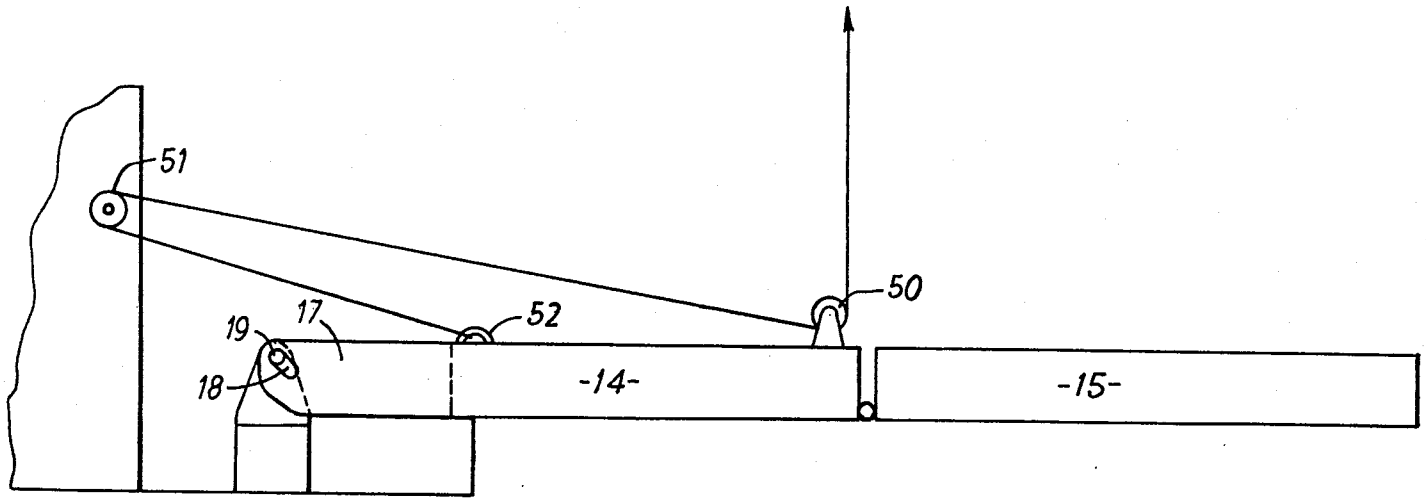
FIG. 8 is a schematic side view of an alternative opening arrangement employing a wire.

The construction may be opened and closed by any suitable operating means and is not restricted to the hydraulic operation described. One alternative operating arrangement is shown in FIG. 8. The construction is identical with that previously described except that the two cover elements 14 and 15 are operated by a wire for example by a crane instead of by piston/cylinder arrangements.

In FIG. 8 the first panel 14 is provided at its hinge end with a sheave 50 mounted centrally on its upper surface. A second sheave 51 is mounted on a support extending from the ships structure above the deck and at a position beyond the pedestal or stowage end of the hatchway in line with the centre of the hatch width. An anchor point 52 for a wire is provided at the end of the cover element 14 remote from the hinge and in line with the centre of the hatch width so that the sheaves 50, 51 and 52 are all in line.

In use a wire is taken from the anchor point 52 via the sheaves 51 and 50 upwardly to a crane. The routing of the wire is shown in the drawing. When an upward pull is applied to the wire end an initial sliding movement is effected by virtue of the direction of pull at the anchor point 52 and displacement of the slots 18 on the pins enable release of the cleating members 31 and 33 which are not shown in this drawing.

It will be appreciated that the constructions described permit automatic cleating to be effected at the sides and also at both ends of the cover arrangement.

The lost motion connection between the first cover element and the pedestals may be effected by any suitable alternative configuration for example the pins 19 may be provided on the arms 17 and the slots in the pedestals or a lost motion facility separate from the pivotal connection may be provided.

A single cover element such as 14 may be employed for some applications. In addition, more than two cover elements hingedly interconnected in sequence may be employed provided suitable operating means were provided to ensure opening and folding. With the wire operated arrangement further sheaves can be provided to allow a multiplicity of cover elements to be opened by a single wire.

Instead of providing the cleating members 31 and 33 at spaced apart positions across the hatch end and cover element respectively, single strip like cleating members having the same wedging function may be provided which extend fully or part way across the hatch end and cover element.

It will be understood that the above description of the present invention is susceptible to various modification changes and adaptations.

I claim:

1. A cover arrangement for a container comprising a cover element which is pivotally coupled at one side to the container via a lost motion connection, the cover and the container having mutually engageable means at said one side which effect cleating, wherein pivotal lowering of the cover element brings said means into alignment and a subsequent lateral movement of the cover in its horizontal position, within the scope of the lost-motion connection, effects engagement of said means.

2. A cover arrangement as claimed in claim 1, wherein the lost motion connection is formed by a pin engaging a slot.

3. A cover arrangement as claimed in claim 2, wherein the slot is sloped so that, following a closing pivotal movement of the cover, the cover tends to perform a movement engaging said means under the effect of gravity.

4. A cover arrangement as claimed in claim 2 or 3 wherein said pin and slot also form the pivotal coupling of the cover element.

5. A cover arrangement as claimed in claim 1 wherein pivotal movement of the cover element is controlled by a hydraulic ram, which is also effective to assist movement of the cover engaging said means.

6. A cover arrangement as claimed in claim 1 wherein the engageable means include mutually camming surfaces which tend to clamp the cover element onto the container.

7. A cover arrangement as claimed in claim 1 wherein additional means are provided for cleating on other sides of the cover element which are automatically engageable and disengageable by said movement of the cover.

8. A cover arrangement as claimed in claim 1 wherein said cover element is pivotted at its opposite side to a further cover element.

9. A ship having a hatch forming a container, which is provided with a cover arrangement as claimed in clam 1.

10. A hatch-cover arrangement for a ship's hatchway comprising a cover element which is pivotally coupled at one edge to said hatchway via a lost motion connection, said cover element and said hatchway having mutually engageable means at said one edge which effect cleating, and a hydraulic ram, said hydraulic ram controlling pivotal movement of said cover element, wherein pivotal lowering of said cover element brings said means into alignment and a subsequent lateral movement of said cover element in its horizontal position, within the scope of said lost motion connection, effects engagement of said means.

11. A hatch-cover arrangement for a ship's hatchway comprising a cover element which is pivotally coupled at one edge to said hatchway via a lost motion connection said cover element and said hatchway having mutually engageable means at said one edge which effect cleating, a wire attached to an anchor point on said cover element, and means for pulling said wire, said wire-pulling means controlling pivotal movement of said cover element, wherein pivotal lowering of said cover element brings said means into alignment and a subsequent lateral movement of said cover element in its horizontal position, within the scope of said lost motion connection, effects engagement of said means.

* * * * *